United States Patent [19]

Shinoda et al.

[11] Patent Number: 5,031,591

[45] Date of Patent: Jul. 16, 1991

[54] OHC VERTICAL CRANKSHAFT ENGINE

[75] Inventors: Akihisa Shinoda; Yoshikazu Yamada; Motohiro Fujita; Naoyuki Kamiya; Hirohisa Ishikawa; Ryoji Saiki; Yuichi Tokito; Makoto Yonezawa; Yoji Fujinaga, all of Saitama, Japan

[73] Assignee: Honda Giken Kogyo Kabushiki Kaisha, Tokyo, Japan

[21] Appl. No.: 472,394

[22] Filed: Jan. 30, 1990

[30] Foreign Application Priority Data

| | | | |
|---|---|---|---|
| Jan. 30, 1989 | [JP] | Japan | 1-20095 |
| Jan. 30, 1989 | [JP] | Japan | 1-20096 |
| Jan. 30, 1989 | [JP] | Japan | 1-20097 |
| Feb. 9, 1989 | [JP] | Japan | 1-30684 |
| Feb. 23, 1989 | [JP] | Japan | 1-21062[U] |
| Feb. 23, 1989 | [JP] | Japan | 1-21065[U] |
| Feb. 23, 1989 | [JP] | Japan | 1-43928 |

[51] Int. Cl.[5] ..... F01M 1/00

[52] U.S. Cl. ..... 123/196 W; 123/90.15

[58] Field of Search ..... 123/196 W, 59, 90.15, 123/90.17, 347, 348

[56] References Cited

U.S. PATENT DOCUMENTS 4,790,273 12/1988 Oguri et al. ..... 123/196 W 4,903,654 2/1990 Sato et al. ..... 123/196 W

FOREIGN PATENT DOCUMENTS 50-42241 12/1975 Japan .

61-175209 1/1985 Japan .

60-113031 6/1985 Japan .

*Primary Examiner*—E. Rollins Cross

*Attorney, Agent, or Firm*—Lyon & Lyon

[57] ABSTRACT

An OHC vertical crankshaft engine, comprising: a vertically disposed crankshaft having a first timing pulley at its lower end; a cooling fan attached to an upper end of the crankshaft; a camshaft extending in parallel with the crankshaft at a cylinder head end of the engine and having a second timing pulley at its lower end; and a timing belt passed around the timing pulleys. Thus, the need for lubrication for the transmission mechanism between the crankshaft and the camshaft is substantially eliminated, and the noise generation is reduced. Additionally, since the upper part of the cylinder head is directly exposed to the cooling air produced by a fan provided at an upper end of the crankshaft, a high engine cooling efficiency can be achieved. This effect is even more enhanced if the exhaust port of the engine is disposed above the intake port and extends horizontally and linearly away from the engine.

14 Claims, 5 Drawing Sheets

OHC VERTICAL CRANKSHAFT ENGINE

TECHNICAL FIELD

The present invention relates to an overhead camshaft engine having a vertically extending crankshaft which is suitable for use in lawn mowers and marine outboard engines among other possible applications.

BACKGROUND OF THE INVENTION

Vertical crankshaft engines are preferred in some applications because of the possibility of simplifying the structure of the power train. Typical applications of vertical crankshaft engines include lawn mowers, grass trimmers, and marine outboard engines. Such applications typically require the engine to be as compact and light-weight as possible. However, when the engine is constructed as a four-stroke engine, it is highly preferable to lubricate the valve mechanism and the cylinder surface, and this necessitates the provision of an oil sump at the bottom end of the engine as well as other complex oil passages and oil seals.

As one such lubrication system, it was proposed in Japanese patent laid-open publication 61-175209 to utilize the negative pressure produced in the crankcase as the piston moves away from it to introduce lubricating oil into the crankcase and the positive pressure produced in the crankcase as the piston moves towards it to push lubricating oil back to a lubricating oil tank through a valve mechanism. However, according to this dry sump lubrication system utilizing crankcase pressure caused by the movement of the piston, it is difficult to achieve a uniformity of oil distribution, and a time lag in supplying oil to various parts of the engine is inevitable to a certain extent.

In a vertical crankshaft engine, its camshaft is also vertical and is driven in synchronism with the crankshaft by a gear train (as disclosed in Japanese UM publication No. 50-42241) or a chain and sprockets (as disclosed in Japanese patent laid open publication No. 60-113031). However, these power transmission systems produce relatively large noises during their operation. Further, they require a relatively large amount of lubricating oil for their lubrication, and it hampers compact and light weight design of such general-purpose engines.

It is possible to use a so-called cogged belt as a timing belt. However, according to conventional arrangement, the timing belt is passed around the pulleys provided at upper ends of the crankshaft and the camshaft, and not only the timing belt is placed in a high temperature condition during the operation of the engine but also air cooling of the engine itself is seriously obstructed by the presence of the timing belt in an upper part of the engine.

BRIEF SUMMARY OF THE INVENTION

In view of such problems of the prior art, a primary object of the present invention is to provide an OHC vertical crankshaft engine which has a favorable lubricating capability.

A second object of the present invention is to provide an OHC vertical crankshaft engine which is provided with a favorable air cooling arrangement.

A third object of the present invention is to provide an OHC vertical crankshaft engine which is capable of quiet operation.

A fourth object of the present invention is to provide an OHC vertical crankshaft engine which is compact in design.

According to the present invention, these and other objects can be accomplished by providing an OHC vertical crankshaft engine, comprising: a vertically disposed crankshaft having a first timing pulley at its lower end; a cooling fan attached to an upper end of the crankshaft; a camshaft extending in parallel with the crankshaft at a cylinder head end of the engine and having a second timing pulley at its lower end; and a timing belt passed around the timing pulleys.

Thereby, the need for lubrication for the transmission mechanism between the crankshaft and the camshaft is substantially eliminated, and the noise generation is reduced. Additionally, the upper part of the cylinder head is directly exposed to the cooling air produced by a fan provided at an upper end of the crankshaft, and a high engine cooling efficiency can be achieved.

According to a preferred embodiment of the present invention, a governor mechanism is provided in the engine so as to be actuated by an outer circumferential surface of the timing belt, and the overall size of the engine can be thereby minimized. To further simplify and reduce the size of the engine, a lower end of the camshaft may be rotatably supported by a slide journal bearing consisting of two halves defined by the cylinder block and the head cover, respectively, in their mutually abutting surfaces. To minimize the length of the conduit connecting a fuel tank with a carburetor, and to utilize the difference in elevation to assist feeding of fuel from the fuel tank to the carburetor, at least a part of the fuel tank for the engine may be disposed above the carburetor.

In order to facilitate the assembling of the timing belt without increasing the vertical dimension of the engine, the timing belt is received in a timing belt chamber defined by a cylinder block and a head cover, and a bottom portion of the timing belt chamber defined by the crankcase is provided with a depression defining a gap wider than a width of the timing belt between an axial end surface of the second timing pulley and the depression. This depression is also helpful in trapping sludge and other foreign matters from being deposited in the lower journal bearing of the camshaft.

To further improve the cooling efficiency of the engine while the overall size of the engine is minimized, according to a particularly preferred embodiment of the present invention, an exhaust port extends horizontally in a first direction from an upper part of a cylinder head of the engine, and an intake port extends horizontally in a second direction opposite to the first direction from a lower part of the cylinder head. By placing the exhaust port in an upper part of the engine and minimizing its length, the cooling efficiency is even more improved.

In order to achieve a favorable lubrication of the engine without requiring a large space for accommodating lubricating oil in the interior of the engine, the engine may include a lubricating oil tank provided separately from a main body of the engine, a lubricating oil supply passage leading from the lubricating oil tank to the interior of a crankcase and to a valve mechanism, and equipped with a one-way valve permitting the flow of lubricating oil only from the lubricating oil tank to the interior of the crankcase and the valve mechanism, an oil reservoir provided in an intermediate part of the lubricating oil supply passage upstream of the one-way valve, and a lubricating oil return passage leading from the interior of the crankcase and the valve mechanism back to the lubricating oil tank, and equipped with a oneway valve permitting the flow of lubricating oil only from the interior of the crankcase and the valve mechanism back to the lubricating oil tank, the lubricating oil passage being branched at the oil reservoir into two parts, one leading to the interior of the crankcase and the other leading to the valve mechanism.

If the lubricating oil tank is made of at least semi-transparent synthetic resin, the level of lubricating oil can be readily inspected without requiring any special oil gage. If the lubricating oil tank is provided with a downwardly projecting boss defining an inlet end of the lubricating oil passage, and the crankcase of the engine is provided with an opening which is adapted to receive the boss, the assembling process for the lubricating oil tank is simplified.

The base structure for mounting the engine can be reinforced by providing a cylinder block of the engine with mounting bosses projecting downward directly therefrom, and utilizing the cylinder block for reinforcing the base structure.

BRIEF DESCRIPTION OF THE DRAWINGS

Now the present invention is described in the following in terms of a specific embodiment with reference to the appended drawings, in which.

DETAILED DESCRIPTION OF THE PREFERRED EMBODIMENT(S)

Figure 1:
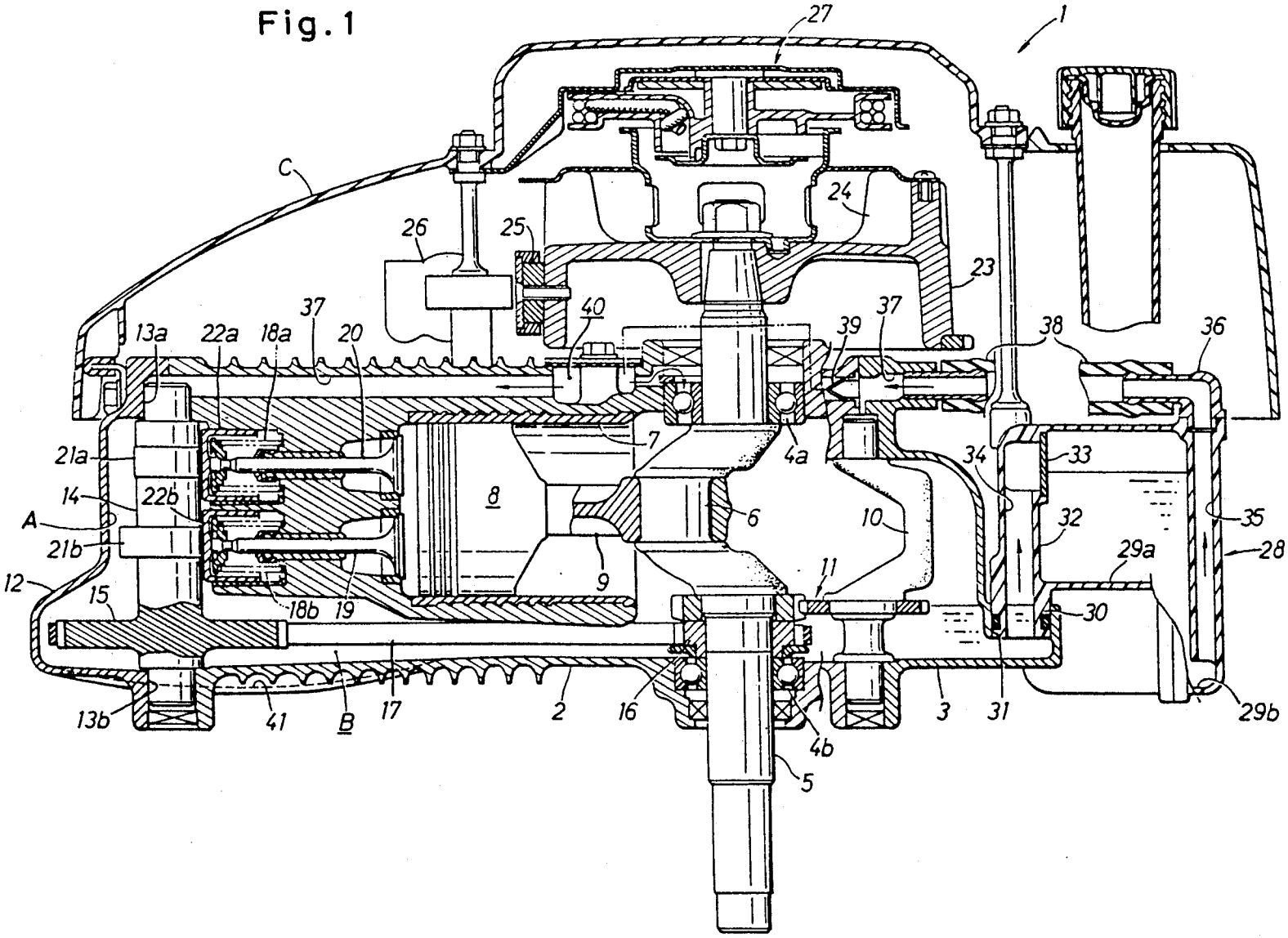
FIG. 1 is a vertical sectional view of an OHC vertical crankshaft engine according to the present invention.
Figure 2:
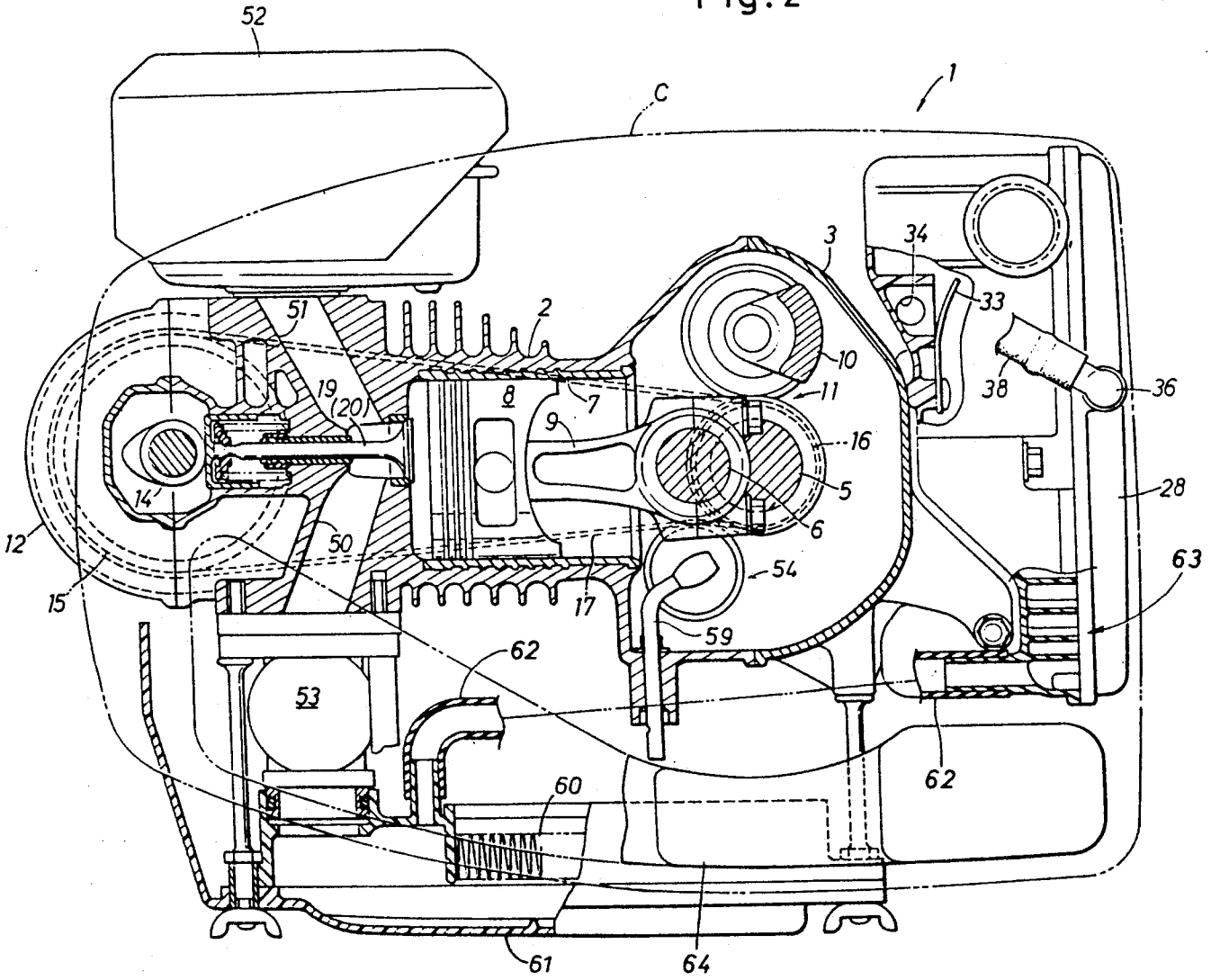
FIG. 2 is a horizontal sectional view of the OHC vertical crankshaft engine according to the present invention.

FIGS. 1 and 2 show a single-cylinder vertical crankshaft OHC engine 1 according to the present invention. A cylinder block 2 of this engine 1 defines a laterally extending cylinder 7 therein. The cylinder block 2 has an open end at its one end (right end as seen in FIGS. 1 and 2) which is closed by a crankcase 3. A pair of ball bearings 4*a* and 4*b* interposed between the cylinder block 2 and the crankcase 4 support a vertically extending crankshaft 5. A piston 8 slidably received in the cylinder 7 is coupled to a crank pin 6 provided in an intermediate part of the crankshaft 5 via a connecting rod 9.

A balancer shaft 10 is also supported by journal bearings, or slide bearings in this case, each of which consists of two halves defined by mutually abutting surfaces of the cylinder block 2 and the crankcase 3. This balancer shaft 10 is intended to cancel a primary unbalanced force produced by the crankshaft 5, and is driven at the same speed but in the opposite direction as the crankshaft 5 by the crankshaft via a gear mechanism 11.

The other end (left end as seen in FIGS. 1 and 2) of the cylinder block 2 is also provided with an open end which is closed by a head cover 12. A pair of journal bearings 13*a* and 13*b* are defined in the interface therebetween to support upper and lower ends of a camshaft 14. The two halves of each of the journal bearings 13*a* and 13*b* are defined by the mutually abutting surfaces of the cylinder block 2 and the head cover 12, respectively. Since the need for the provision of journal bearings for the camshaft 14 inside the head cover 12 is thus eliminated as opposed to the conventional valve actuating mechanism, a significant reduction in the number of component parts and simplification of the assembling process can be accomplished. The cylinder block 2, the crankcase 3 and the head cover 12 may be made of die cast aluminum alloy or the like.

This camshaft 14 is provided with a pair of cam lobes 21*a* and 21*b*, and a timing pulley 15 located between the lower cam lobe 21*b* and the lower end of the camshaft 14 supported by the journal bearing 13*b*, and a timing belt 17 is passed around this timing pulley 15 and a smaller timing pulley 16 which is integrally formed with a part of the crankshaft 5 located between the crank pin 6 and the lower bearing 4*b* so that the rotation of the crankshaft 5 may be transmitted to the camshaft 14 at the ratio of two to one.

As can be seen from FIG. 1, according to the present embodiment, the cylinder block 2 is integrally provided with a cylinder head. The cylinder head is provided with an intake port 50 and an exhaust port 51 in a vertically spaced relationship, and an intake valve 19 and an exhaust valve 20 provided in the associated ports are urged towards their closed positions by associated valve springs 18*a* and 18*b*. The valves 19 and 20 are thus disposed in a plane parallel with the plane containing the axial center line of the crankshaft 5, and are actuated as required according to the rotation of the crankshaft 5 by means of the cam lobes 21*a* and 21*b* acting upon the stem ends of the intake and exhaust valves 19 and 20 by way of direct valve lifters 22*a* and 22*b*, respectively.

To the upper end of the crankshaft 5 is securely attached a flywheel 23 having fan blades 24 on its upper end surface to create a cooling air flow, and a permanent magnet piece 25 on its outer circumferential surface to cooperate with an ignition device 26 mounted on an appropriate part of the cylinder block 2 and produce ignition sparks at appropriate timing. A recoil starter 27 is attached to the upper extreme end of the crankshaft 5. An upper part of the engine 1 is generally covered by an inverted cup-shaped cover C made of synthetic resin.

To the right of the crankcase 3 is disposed a lubricating oil tank 28 which is made of transparent or semi-transparent synthetic resin. The bottom wall of this lubricating oil tank 28 consists of a shallow part 29*a* and a deep part 29*b*. A boss portion 30 depending from one side of the shallow bottom wall part 29*a* is fitted into an opening 31 of the crankcase 3 leading to the interior of thereof, by way of an O-ring. An upper part of this lubricating oil tank 28 is communicated with a bottom portion of the crankcase 3 which is below the surface level of the lubricating oil received in the crankcase 3 via an oil passage 34 internally defined by the boss portion 30 and extending, along a side wall 32 of the lubricating oil tank 28, ultimately to the upper part of the lubricating oil tank 28 via a reed valve 33 to permit flow of lubricating oil only from the crankcase 3 to the lubricating oil tank 28. A bottom end portion adjacent to the deep bottom wall part 29*b* of the lubricating oil tank 28 is communicated, via a vertical passage 35 integrally provided in the lubricating oil tank 28, a tube coupling 36, and a flexible tube 38, with an oil passage 37 defined in an upper wall of the cylinder block 2 and the crankcase 3 to supply lubricating oil to the upper ball bearing 4a for the crankshaft 4, the upper journal bearing for the balancer shaft 10, and the upper journal bearing 13a for the camshaft 14. A one-way valve 39 is provided in a part of the passage 37 immediately upstream of the upper ball bearing 4a to permit flow of lubricating oil only from the oil tank 28 to the upper journal bearings 4a and 13a for the crankshaft 5 and the camshaft 14. The oil passage 37 includes an oil reservoir 40 between the ball bearing 4a and the slide bearing 13a.

Figure 3:
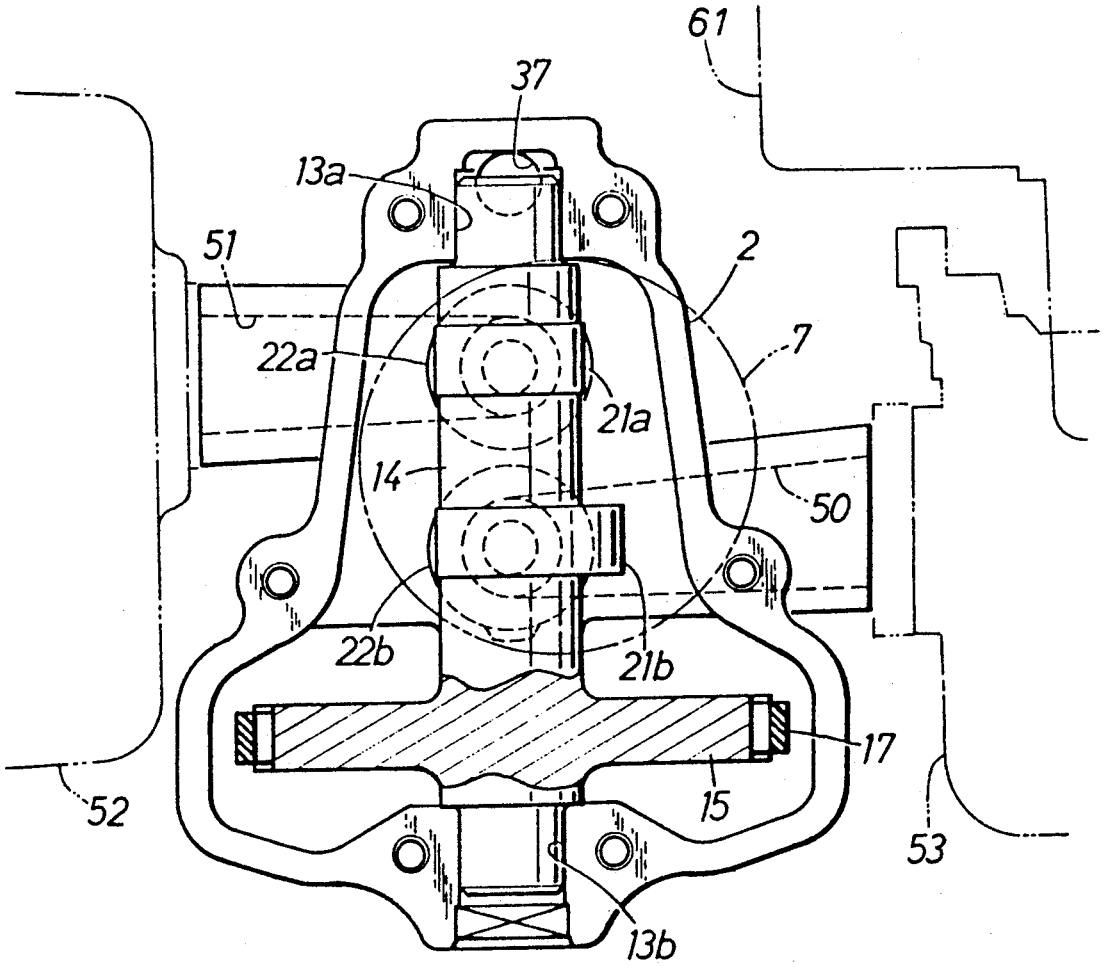
FIG. 3 is an end view showing a cylinder head structure of the engine with its head cover removed.

As best shown in FIG. 3, the intake port 50 extends laterally away in one direction from the cylinder block 3 (downwardly as seen in FIG. 2) and the exhaust port 51 extends laterally away in another direction from cylinder block 3 (upwardly as seen in FIG. 2), In other words, the line of intake and exhaust gas flow is perpendicular to the axial line of the crankshaft 5. The exhaust port 51 thus extends horizontally and in parallel with and above the intake port 50.

The free end or the downstream end of the exhaust port 51 is directly connected to an exhaust muffler 52, while the free end or the upstream end of the intake port 50 is directly connected to a carburetor 53.

Figure 4:
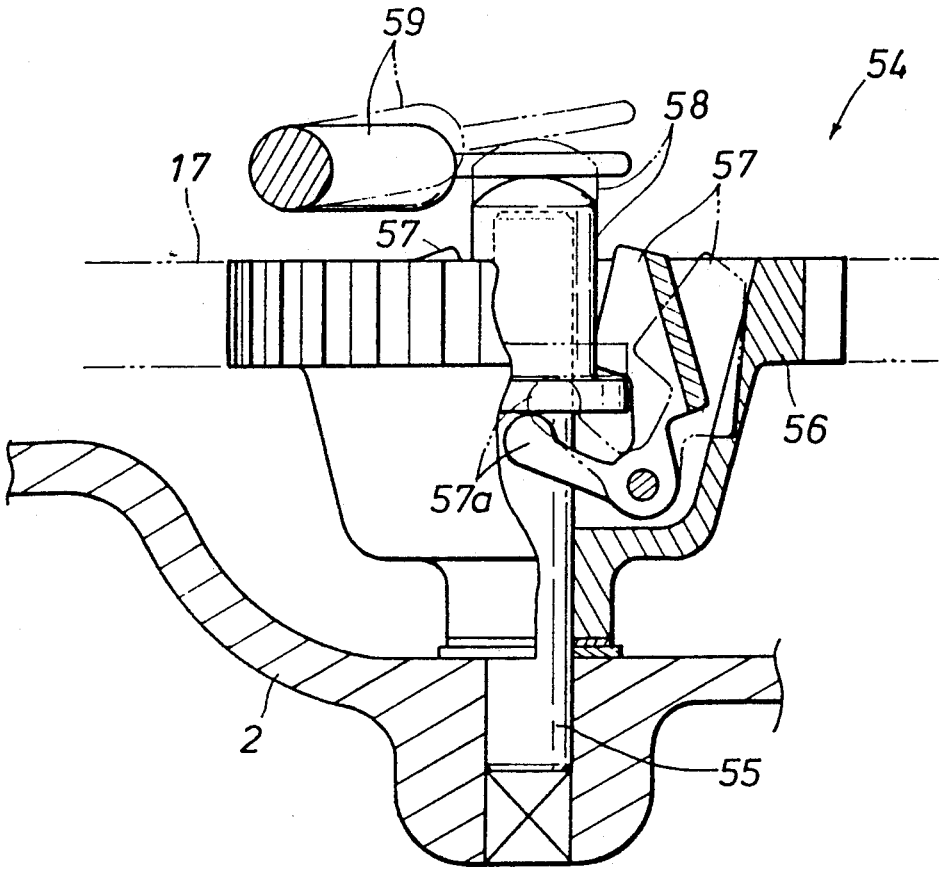
FIG. 4 is a fragmentary and enlarged sectional side view of a governor mechanism for the engine according to the present invention.

Referring to FIGS. 2 and 4, a throttle valve (not shown in the drawings) of this carburetor 53 is controlled by a governor mechanism 54 by way of a linkage not shown in the drawings, and the rotation of the crankshaft 5 is transmitted to the governor mechanism 54 by the external or the revere side of the timing belt 17.

The governor mechanism 54 consists of a centrifugal governor mechanism, and comprises a fixed shaft 55 standing upright from a bottom wall of the cylinder block 2, a governor holder 56 which is coaxially and rotatably supported by this fixed shaft 55 and drivingly meshes with the teeth on the reverse or the outer surface of the timing belt 17 at its outer circumferential surface, a pair of governor weights 57 pivotally supported by the governor holder 56 so as to be pivoted away from the central part of the governor holder 56 when they are subjected to a centrifugal force resulting from their rotation with the governor holder 56, a governor slider 58 which is slidably fitted on the upper end of the fixed shaft 55 and is adapted to be lifted by arms 57a provided in the governor weights 57 as they pivot away from the fixed shaft 55, and a governor arm 59 which is passed through a side wall of the cylinder block 2 and is engaged by the free end of the governor slider 58 at its inner end and with the throttle valve of the carburetor 53 at its outer end.

Thus, since the governor holder 56 of the governor mechanism 54 is driven by the timing belt 17, the governor mechanism 54 can control the throttle valve of the carburetor 53 in such a manner as to keep the rotational speed of the engine at a fixed level as determined by a balance between the spring restoring force acting upon the throttle valve and the centrifugal force acting on the governor weights 57.

According to the present embodiment, the outer circumferential surface of the governor holder 56 was provided with teeth to ensure secure meshing with the teeth on the reverse or the outer circumferential side of the timing belt 17, but such teeth may be omitted if frictional engagement therebetween is sufficient to ensure a satisfactory operation of the governor mechanism 54.

The upstream end of the carburetor 53 is connected to an air cleaner case 61 accommodating a filter element 60 made of filtering paper.

When the flywheel 23 is turned by the crankshaft 5 during the operation of this engine 1, the fan blades 24 provided on the flywheel 23 function as a centrifugal fan, and blow air downwards along to the inner surface of the cover C thereby cooling the cylinder block 2. Since the exhaust port 51 placed under a relatively high temperature condition is located closer to the cooling fan blades 24, a high cooling efficiency can be achieved. Additionally, since the exhaust port 51 extends substantially linearly and horizontally, the heat conduction and radiation from the exhaust port region to other parts of the engine can be minimized, thereby preventing any ill effects on the operation of the engine due to the heat from the exhaust system.

A fuel tank 64 is arranged above the carburetor 53 and the air cleaner case 61 so as to partly overlap them, and the cover C serving also as a fan shroud is integrally formed with this fuel tank 64. Since the intake port 50 is located in a relatively low part of the engine while the fuel tank 64 is placed in a relatively high part of the engine, the difference in elevation between the fuel tank 64 and the carburetor 53 can be maximized, and a favorable feeding of fuel is made possible. Moreover, according to the present embodiment, since the fuel tank 64 partly overlaps the carburetor 53 as seen from above, this effect is even more enhanced allowing the length of the conduit for leading fuel from the fuel tank 64 to the carburetor 53 to be minimized.

Now the mode of operation of the lubricating system of this engine is described in the following.

The lubricating oil tank 28 contains a predetermined amount of lubricating oil. As the piston 8 moves leftward as seen in FIGS. 1 and 2 for its compression or exhaust stroke, the interior of the crankcase 3 as well as a valve mechanism chamber A inside the head cover 12 is brought into a negative pressure condition, and the lubricating oil in the lubricating oil tank 28 flows into the valve mechanism chamber A via an upstream part of the oil supply passage 37, the one-way valve 39, the oil reservoir 40, and a downstream part of the oil supply passage 37 on one hand and into the crankcase 3 via the upper ball bearing 4a for the crankshaft 5 on the other hand.

Since a certain amount of lubricating oil is always stored in the oil reservoir 40, lubricating oil can quickly reach all parts of the engine in most conditions including the time when the engine has been just started.

Conversely, as the piston 8 moves rightward as seen in FIGS. 1 and 2 for its combustion or scavenging stroke, and the interior of the crankcase 3 is thereby brought into a positive pressure condition, the one-way valve 39 is closed and the lubricating oil in the crankcase 2 is pushed back into the lubricating oil tank 28 via the oil return passage 34 and the reed valve 33.

The downstream end of the air cleaner case 61 is communicated with the upper space of the lubricating oil tank 28 via a flexible tube 62 (FIG. 2) and a baffle plate structure 63 provided in an upper part of the lubricating oil tank 28. Thus, when the piston 8 moving in a direction to reduce the volume of the crankcase 3, the lubricating oil is effectively forced back into the lubricating oil tank 28 via the oil passage 34 assisted by the negative pressure introduced into the crankcase 3 through this flexible tube 62. In this way, the amount of the lubricating oil received in the bottom region of the interior of the engine can be minimized.

When assembling this engine, the timing belt 17 is passed loosely around the pulley 16 before interposing the crankshaft 5 between the cylinder block 2 and the crankcase 3 by way of the ball bearings 4*a* and 4*b*.

Then, the timing belt 17 is received in a belt housing B defined in a bottom region of the space defined by the cylinder block 2 and the head cover 12, and the camshaft end of the timing belt 17 is drawn out from the other open end of the cylinder block 2 upon which the head cover 12 is to be mounted. Then, the camshaft 14 is mounted on this open end of the cylinder block 2, and the timing belt 17 is passed around the pulley 15 of the camshaft 4. This is made possible by providing a depression 41 to a bottom part of the belt chamber B so that the timing belt 17 may be placed in a space defined between the bottom surface of the belt chamber B and the opposing axial end surface of the pulley 15. Once the timing belt 17 is passed around the pulley 15, the head cover 12 is mounted on the open end of the cylinder block 2 interposing the camshaft 14 therebetween by way of the slide journal bearings 13*a* and 13*b*. In this way, assembling of the timing belt 17 is simplified without increasing the vertical dimension of the engine. Furthermore, since the lubricating oil which is supplied from the oil passage 37 and has lubricated the valve mechanism is received by this depression 41, which may be disposed lower than the upper end of the boss defining the lower journal bearing 13*b* for the camshaft 14, without directly exposing the lower journal bearing 13*b* to this oil, any sludge or metallic powder which may be produced during the operation of the engine would not be deposited in the lower journal bearing 13*b* thereto. Further, since the lower journal bearing 13*b* is not submerged in lubricating oil, the burden on the oil seal for the lower journal bearing 13*b* is reduced.

Figure 7:
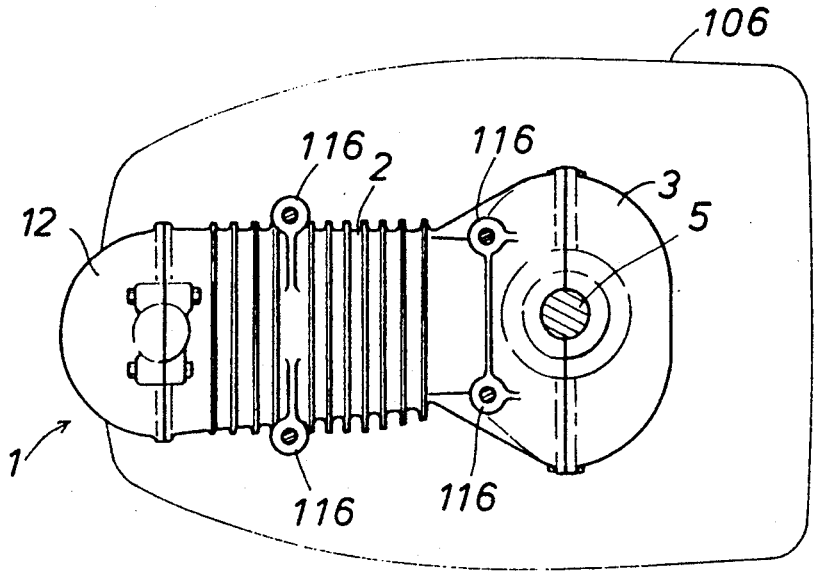
FIG. 7 is bottom view of the engine according to the present invention.
Figure 5:
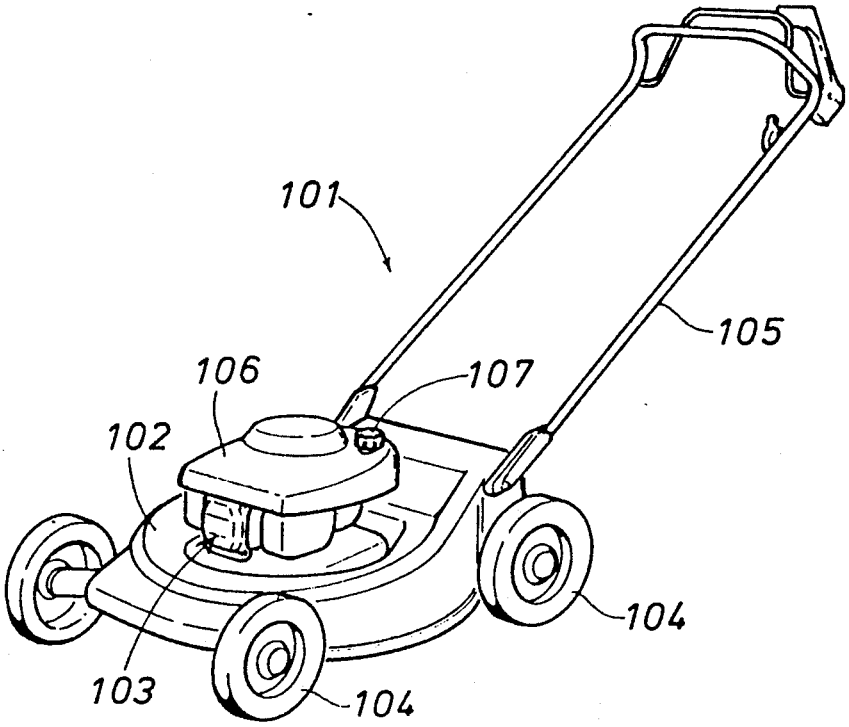
FIG. 5 is a perspective view of a lawn mower carrying an engine according to the present invention.
Figure 6:
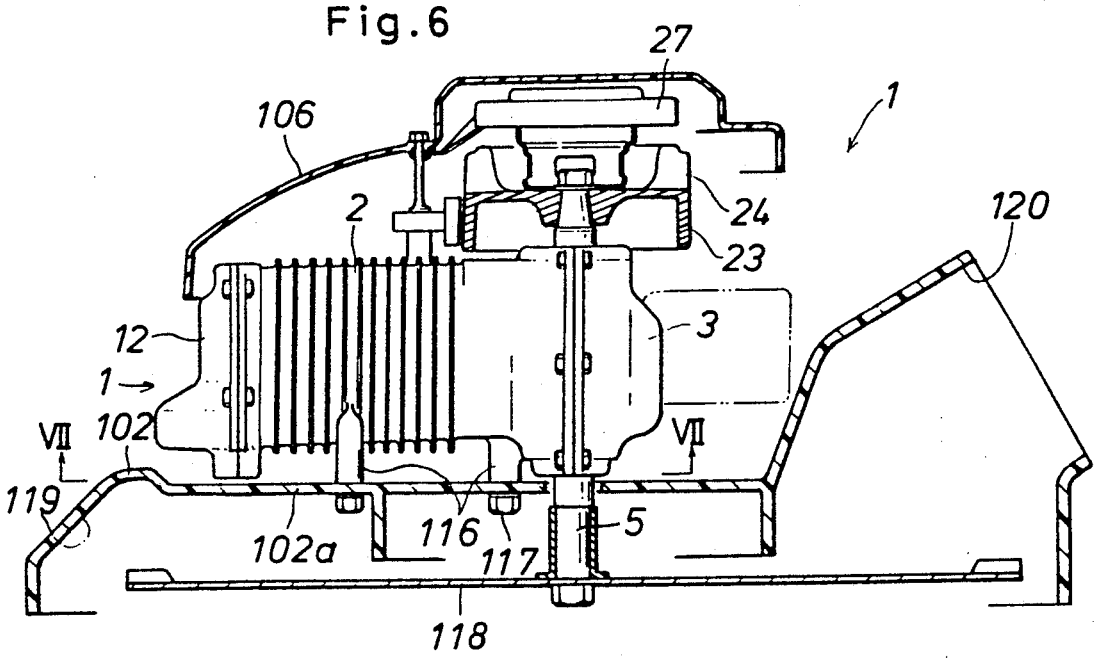
FIG. 6 is a vertical sectional view of the lawn mower shown in FIG. 5.

FIGS. 5 through 7 illustrate a lawn mower 101 on which the above described engine 1 is mounted.

This lawn mower 101 comprises an inverted cup-shaped cutter housing 102, and a power unit 103 mounted on its upper surface 102*a* for driving a cutter blade 118 received in the cutter housing 102. The cutter housing 102 serves also as a structural frame, and is additionally provided with wheels 104 at four diagonal corner positions thereof and a handle bar 105 extending rearwardly and upwardly therefrom.

The power unit 103 is fixedly attached to the upper surface 102*a* of the cutter housing 102 at its lower end, and its upper surface is covered by a cover 106 having a fuel inlet 107 closed by a filler cap.

As best shown in FIG. 6, the power unit 103 includes the engine main body 1 comprising the flywheel 23 and the recoil starter 27 as well as the crankcase 3, the cylinder block 2 and the head cover 12.

As best shown in FIG. 7, the cylinder block 2 is provided with four mounting bosses 116 for mounting the engine main body 1 on the upper surface 102*a* of the cutter housing 102. Threaded bolts 117 are passed through the cutter housing 102 from below and are threaded with the threaded holes of the mounting bosses 116. Since two of the bosses 116 are provided adjacent to the crankshaft 5 while the other two are provided remote therefrom, the reaction of the engine output torque acting upon the cutter housing 102 can be easily born by the cutter housing 102, and the thickness or the weight of the cutter housing 102 can be safely reduced. Furthermore, since the cylinder block 2 serves as a structural member reinforcing the upper part of the cutter housing 102, the thickness of the cutter housing can be reduced for this reason also.

To the output end or the lower end of the crankshaft 5 is mounted the cutter blade 118 which is received in the cutter housing 102 in such a manner that an air passage 119 is defined between the upper inner surface of the cutter housing 102 and the cutter blade 118. This air passage 119 is communicated with an air outlet 120 defined in a rear end of the cutter housing 102 so that the grass blades mowed by the cutter blade 118 may be guided and expelled out of the air outlet 120.

What we claim is:

1. An OHC vertical crankshaft engine, comprising:
- a vertically disposed crankshaft having a first timing pulley at its lower end;
- a cooling fan attached to an upper end of said crankshaft;
- a camshaft extending in parallel with said crankshaft at a cylinder head end of said engine and having a second timing pulley at its lower end; and
- a timing belt passed around said timing pulleys.

2. An OHC vertical crankshaft engine according to claim 1, wherein a cylinder block of said engine is provided with a plurality of mounting bosses projecting downward directly therefrom.

3. An OHC vertical crankshaft engine according to claim 1, further comprising a governor mechanism, for controlling the rotational speed of said engine, which is adapted to be actuated by said timing belt.

4. An OHC vertical crankshaft engine according to claim 3, wherein said governor mechanism is adapted to be actuated by an outer circumferential surface of said timing belt.

5. An OHC vertical crankshaft engine according to claim 1, wherein said first timing pulley is located between a lower journal bearing for said crankshaft and a crank pin adjacent thereto.

6. An OHC vertical crankshaft engine according to claim 5, wherein said timing belt is received in a timing belt chamber defined by a cylinder block and a head cover, and a bottom portion of said timing belt chamber defined by said cylinder block is provided with a depression defining a gap wider than a width of said timing belt between an axial end surface of said second timing pulley and said depression.

7. An OHC vertical crankshaft engine according to claim 5, wherein a lower end of said camshaft is rotatably supported by a slide journal bearing consisting of two halves defined by said cylinder block and said head cover, respectively, in their mutually abutting surfaces, and said second timing pulley is located between said lower journal bearing for said camshaft and a cam lobe adjacent thereto.

8. An OHC vertical crankshaft engine, comprising:
- a vertically disposed crankshaft;
- a cooling fan attached to an upper end of said crankshaft;
- a camshaft extending in parallel with said crankshaft at a cylinder head end of said engine;
- an exhaust port extending horizontally in a first direction from an upper part of a cylinder head of said engine; and
- an intake port extending horizontally in a second direction opposite to said first direction from a lower part of said cylinder head.

9. An OHC vertical crankshaft engine according to claim 8, wherein a cylinder block of said engine is provided with mounting bosses projecting downward directly therefrom.

10. An OHC vertical crankshaft engine according to claim 8, wherein a timing pulley is passed around a first timing pulley provided at a lower end of said crankshaft and a second timing pulley provided at a lower end of said camshaft.

11. An OHC vertical crankshaft engine according to claim 8, wherein a carburetor is connected to an upstream end of said intake port, and at least a part of a fuel tank for said engine is disposed above said carburetor.

12. An OHC vertical crankshaft engine, comprising:

a vertically disposed crankshaft;

a camshaft extending in parallel with said crankshaft at a cylinder head end of said engine;

a lubricating oil tank provided separately from a main body of said engine;

a lubricating oil supply passage leading from said lubricating oil tank to the interior of a crankcase and to a valve mechanism, and equipped with a one-way valve permitting the flow of lubricating oil only from said lubricating oil tank to the interior of said crankcase and said valve mechanism;

an oil reservior provided in an intermediate part of said lubricating oil supply passage upstream of said one-way valve; and lubricating oil return passage leading from the interior of said crankcase and said valve mechanism back to said lubricating oil tank, and equipped with a one-way valve permitting the flow of lubricating oil only from the interior of said crankcase and said valve mechanism back to said lubricating oil tank;

said lubricating oil passage being branched at said oil reservoir into two parts, one leading to the interior of said crankcase and the other leading to said valve mechanism.

13. An OHC vertical crankshaft engine according to claim 12, wherein said lubricating oil tank is made of at least semi-transparent synthetic resin.

14. An OHC vertical crankshaft engine according to claim 12, wherein said lubricating oil tank is provided with a downwardly projecting boss defining an inlet end of said lubricating oil passage, and said crankcase of said engine is provided with an opening which is adapted to receive said boss.

* * * * *